US012055140B2

(12) United States Patent
Bohnert

(10) Patent No.: US 12,055,140 B2
(45) Date of Patent: Aug. 6, 2024

(54) ELECTRIC-MOTOR-DRIVEN HYDRAULIC PUMP ACTUATOR

(71) Applicant: Schaeffler Technologies AG & Co. KG, Herzogenaurach (DE)

(72) Inventor: Michael Bohnert, Kappelrodeck (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 18/286,998

(22) PCT Filed: Apr. 8, 2022

(86) PCT No.: PCT/DE2022/100269
§ 371 (c)(1),
(2) Date: Oct. 14, 2023

(87) PCT Pub. No.: WO2022/228606
PCT Pub. Date: Nov. 3, 2022

(65) Prior Publication Data

US 2024/0035470 A1 Feb. 1, 2024

(30) Foreign Application Priority Data

Apr. 28, 2021 (DE) ..... 10 2021 110 892.6

(51) Int. Cl.
*F04C 15/00* (2006.01)
*F04C 2/08* (2006.01)
*F04C 2/14* (2006.01)

(52) U.S. Cl.
CPC ..... *F04C 15/0061* (2013.01); *F04C 2/08* (2013.01); *F04C 2/14* (2013.01); *F04C 2240/30* (2013.01);
(Continued)

(58) Field of Classification Search
CPC .... F04C 2240/50–56; F04C 18/08–088; F04C 18/12–20; F04C 2/08–088;
(Continued)

(56) References Cited

U.S. PATENT DOCUMENTS 3,198,127 A 8/1965 Brundage
3,804,562 A * 4/1974 Hansson ..... F01C 21/102 403/259
(Continued)

FOREIGN PATENT DOCUMENTS

CN 106704187 A 5/2017
DE 4118950 A1 2/1993
(Continued)

*Primary Examiner* — Laert Dounis

(57) ABSTRACT

The disclosure relates to an electric-motor-driven hydraulic pump actuator with two plate-like housing elements which are connected sealingly to one another with the interposition of an intermediate plate in order to form a housing in which a drive shaft is rotatably mounted.
In order to improve the functionality and/or simplify manufacture of the electric-motor-driven hydraulic pump actuator, a bearing device for the drive shaft is secured in one of the housing elements by means of a spring device that passes through the intermediate plate via a through-hole through which the drive shaft extends.

20 Claims, 2 Drawing Sheets

(52) U.S. Cl.
CPC ..... *F04C 2240/40* (2013.01); *F04C 2240/52* (2013.01)

(58) Field of Classification Search
CPC ..... F04C 2/12–20; F01C 1/08–088; F01C 1/12–20
See application file for complete search history.

(56) References Cited

U.S. PATENT DOCUMENTS

| | | | | |
|---|---|---|---|---|
| 5,657,629 | A | 8/1997 | Folsom | |
| 2013/0129551 | A1* | 5/2013 | Tsubai | F04C 23/008 418/55.4 |
| 2020/0309121 | A1 | 10/2020 | Jang | |
| 2021/0054843 | A1* | 2/2021 | Crochet | B60T 8/885 |

FOREIGN PATENT DOCUMENTS

| | | | |
|---|---|---|---|
| DE | 102005058843 | A1 | 7/2006 |
| DE | 102010054250 | A1 | 6/2011 |
| DE | 102016121237 | A1 | 5/2018 |
| DE | 102019107961 | A1 | 10/2020 |
| DE | 102019133933 | A1 | 1/2021 |
| DE | 102019133966 | A1 | 6/2021 |
| EP | 2516860 | B1 | 3/2014 |
| WO | 2020192819 | A1 | 10/2020 |

* cited by examiner

ELECTRIC-MOTOR-DRIVEN HYDRAULIC PUMP ACTUATOR

CROSS-REFERENCE TO RELATED APPLICATIONS

This application is the U.S. National Phase of PCT Application No. PCT/DE2022/100269 filed on Apr. 8, 2022, which claims priority to DE 10 2021 110 892.6 filed on Apr. 28, 2021, the entire disclosures of which are incorporated by reference herein.

TECHNICAL FIELD

The disclosure relates to an electric-motor-driven hydraulic pump actuator.

BACKGROUND

A hydraulic control with a control plate arrangement and with a hydraulic conveying device for conveying a hydraulic medium is known from German published patent application DE 10 2010 054 250 A1, wherein the hydraulic conveying device is integrated into the control plate arrangement, wherein a first hydraulic pump is integrated into a first control plate of the control plate arrangement, wherein a second hydraulic pump is integrated into a second control plate of the control plate arrangement, wherein the two hydraulic pumps are driven by a common pump shaft, wherein an intermediate plate is arranged between the two control plates, through which a pedestal bearing extends from the first into the second control plate. An intermediate plate of an electrohydraulic control device is known from German published patent application DE 10 2005 058 843 A1, wherein the control device has a control housing with at least two control housing parts provided with fluid channels, between which the intermediate plate is arranged and creates connections between fluid channels of the control housing parts via passages provided at least in regions, and the control housing is provided with at least one electrically actuated valve, wherein the intermediate plate is designed to fix the valve to the control housing.

SUMMARY

The object of the disclosure is to improve the functionality and/or simplify manufacture of an electric-motor-driven hydraulic pump actuator with two plate-like housing elements which are connected to one another in a sealed manner with the interposition of an intermediate plate in order to form a housing in which a drive shaft is rotatably mounted.

The object is achieved, for an electric-motor-driven hydraulic pump actuator with two plate-like housing elements which are connected to one another in a sealed manner with the interposition of an intermediate plate in order to form a housing in which a drive shaft is rotatably mounted. A bearing device for the drive shaft is secured in one of the housing elements by means of a spring device that passes through the intermediate plate via a through-hole through which the drive shaft extends. The plate-like housing elements can take the form of plates and are then also referred to as housing plates. An electric motor is arranged in one of the plate-like housing elements, which constitutes the electric motor drive of the hydraulic pump actuator. A hydraulic pump is arranged in the other housing element, which is driven by the electric motor via the drive shaft. The intermediate plate performs a sealing function between the two plate-like housing elements. In addition, the intermediate plate advantageously has connecting openings that allow hydraulic medium to pass through. The intermediate plate also advantageously serves to provide at least one valve function. In addition to its sealing function and other known functions of the multi-functional intermediate plate, the through-hole provided for the drive shaft in the intermediate plate is advantageously used to provide a feedthrough for the spring device and to secure the bearing device for the drive shaft in the housing element. The bearing device can be secured in an axial direction. The term "axial" refers to an axis of rotation of the drive shaft. "Axial" means in the direction of or parallel to the axis of rotation of the drive shaft. The bearing device can include a fixed bearing and a floating bearing. The spring device can be used to axially secure the fixed bearing of the bearing device. This provides a cost-effective solution for securing the bearing device that is neutral with regard to the required installation space.

An exemplary embodiment of the electric-motor-driven hydraulic pump actuator is characterized in that the spring device exerts an axial clamping force on the bearing device for the drive shaft in the housing element. The bearing device is arranged in a housing recess of the housing element. The bearing device, in particular the fixed bearing of the bearing device, is supported both on the drive shaft and on the housing element on a side facing away from the spring device. The axial clamping force is applied to the other side of the bearing device by the spring device. For this purpose, a corresponding overlap exists between the bearing device, in particular a bearing outer ring of the fixed bearing, and the intermediate plate.

An exemplary embodiment of the electric-motor-driven hydraulic pump actuator is characterized in that the spring device takes the form of a disk spring, which comprises a preloading region that is preloaded in a spring-like manner against the bearing device in the housing element.

An exemplary embodiment of the electric-motor-driven hydraulic pump actuator is characterized in that the spring device preloads an axial plate in the direction of gear wheels and the housing element. The gear wheels are the pump wheels of a pump of the pump actuator, which are mounted in the housing element by means of, for example, pedestal bearings. In such pumps, the axial plate must be preloaded in the direction of the pump wheels. This is usually done by means of one or two disc springs. Particularly advantageously, the disc spring used to preload the axial plate can simultaneously serve as a spring device for securing the bearing device. The through-hole in the intermediate plate provided for the drive shaft then only needs to be provided with a larger opening so that the disc spring can act as a spring device on the bearing device.

An exemplary embodiment of the electric-motor-driven hydraulic pump actuator is characterized in that the bearing device takes the form of a fixed bearing which is combined in the housing element with a floating bearing for the drive shaft. This type of bearing is known per se. It is essential that the fixed bearing is axially secured by the spring device. This eliminates the need to press the fixed bearing into the housing element or to secure it with a retaining ring.

An exemplary embodiment of the electric-motor-driven hydraulic pump actuator is characterized in that a rotor of the electric motor drive is arranged in the housing element on the drive shaft between the fixed bearing and the floating bearing. This provides a stable bearing for the electric motor drive of the hydraulic pump actuator. In a manner known per se, the rotor is rotatably arranged within a stator of an electric motor which, together with a corresponding stator winding and the rotor, constitutes an electric motor.

An exemplary embodiment of the electric-motor-driven hydraulic pump actuator is characterized in that an end of the drive shaft projecting from the housing element through the intermediate plate into the other housing element drives a hydraulic pump in the other housing element. The hydraulic pump is used to provide hydraulic pressure. Thus, the electric-motor-driven hydraulic pump actuator can advantageously be used, for example, in a transmission control system and/or a coupling control system.

An exemplary embodiment of the electric-motor-driven hydraulic pump actuator is characterized in that the housing element is formed of a housing material having a significantly different thermal expansion than the material of the bearing outer ring. The bearing outer ring is, for example, formed of a steel material. The housing element is, for example, formed of an aluminum material. Use of the spring device to secure the bearing device, as described above, eliminates the need for increased bearing clearance that would otherwise be required when installing the bearing device. This can reduce manufacturing costs.

An exemplary embodiment of the electric-motor-driven hydraulic pump actuator is characterized in that the hydraulic pump in the other housing element takes the form of an external gear pump. In a manner known per se, the external gear pump comprises a pump chamber in which two pump wheels mesh with one another.

An exemplary embodiment of the electric-motor-driven hydraulic pump actuator is characterized in that the bearing device takes the form of a rolling bearing with an outer ring, against which the spring device is axially preloaded. Both the fixed bearing and the floating bearing can take the form of rolling bearings. The spring device is axially preloaded against the outer ring of the fixed bearing. This advantageously makes it possible to dispense with a retaining ring for axial securing of the fixed bearing.

BRIEF DESCRIPTION OF THE DRAWINGS

Further advantages, features and details of the disclosure are apparent from the following description, in which various exemplary embodiments are described in detail with reference to the drawings, in which.

DETAILED DESCRIPTION

Figure 1:
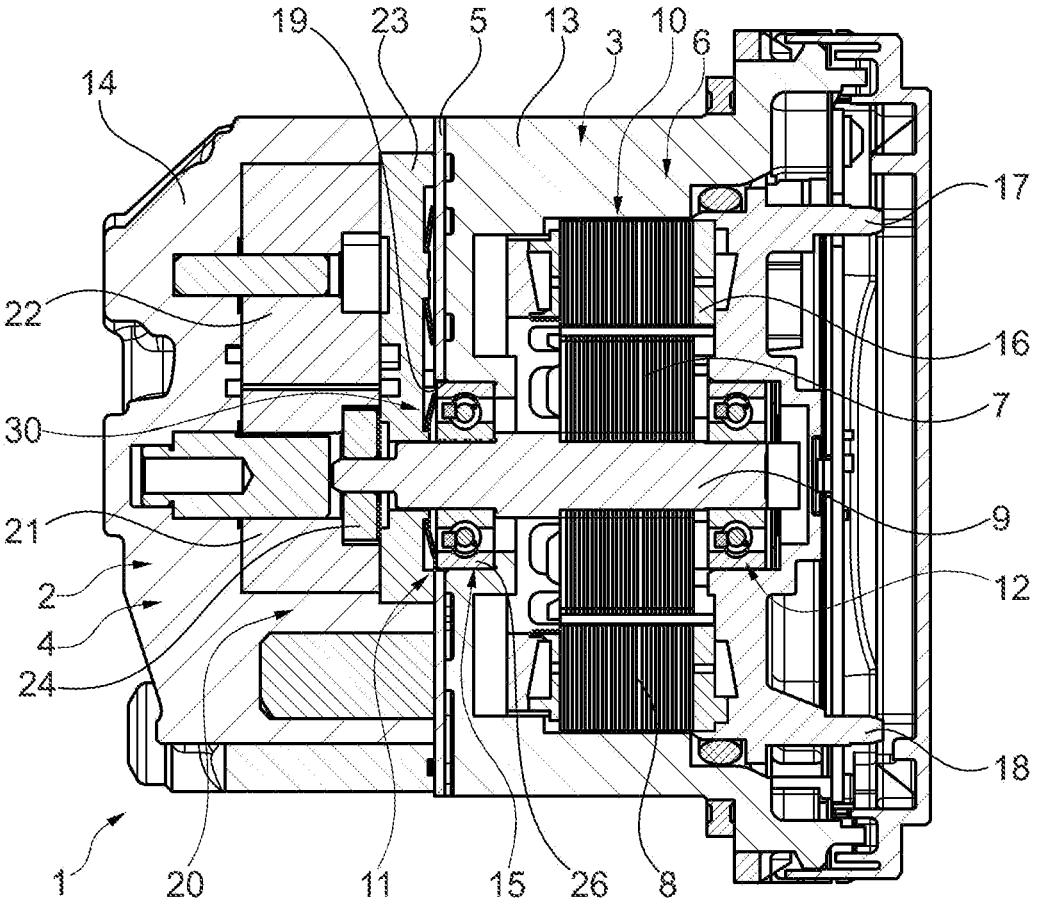
FIG. 1 shows an electric-motor-driven hydraulic pump actuator with two plate-like housing elements which are connected to one another in a sealed manner with the interposition of an intermediate plate, with a rotatably mounted drive shaft in a longitudinal section through the drive shaft.
Figure 2:
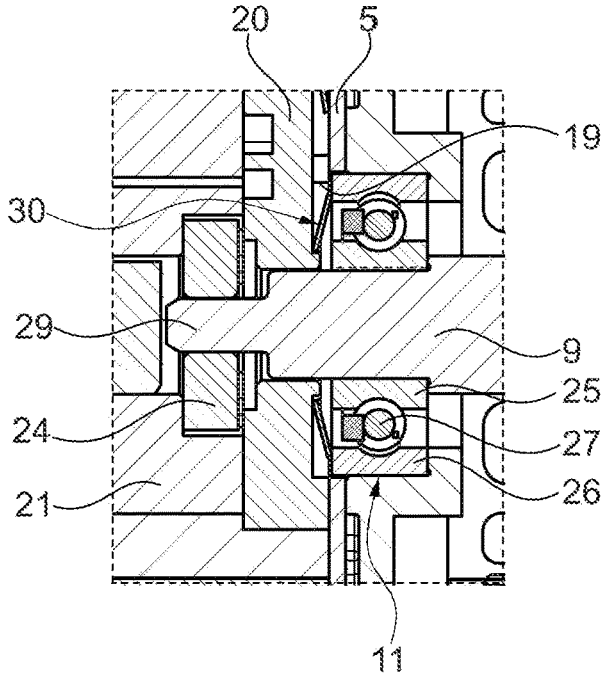
FIG. 2 shows an enlarged detail of FIG. 1 with a bearing device for the drive shaft.

FIGS. 1 and 2 show a longitudinal section of an electric-motor-driven hydraulic pump actuator 1. The electric-motor-driven hydraulic pump actuator 1 comprises a housing 2.

The housing 2 comprises two plate-like housing elements 3, 4, also referred to as housing plates 3, 4. An intermediate plate 5 is arranged between the two housing elements 3, 4.

Arranged in the housing element 3 is an electric motor 6 with a rotor 7, which is rotatable in a stator 8. The rotor 7 is mounted on a drive shaft 9. The electric motor 6 with the rotor 7 and the stator 8, together with the drive shaft 9, constitutes an electric motor drive 10 of the hydraulic pump actuator 1.

The drive shaft 9 is rotatably mounted in the housing element 3 by means of a fixed bearing 11 and a floating bearing 12. The rotor 7 is arranged between the fixed bearing 11 and the floating bearing 12 on the drive shaft 9.

The fixed bearing 11 and the floating bearing 12 constitute a bearing device 15 for the drive shaft 9 in the housing element 3. On a side facing away from the intermediate plate 5, centering means 17, 18 are provided on the housing element 3 for a printed circuit board of a control system.

Channels and valves are provided in the housing element 3 (not shown in FIGS. 1 and 2). Therefore, the housing element 3 is also referred to as a valve plate 13. A hydraulic pump 20 is arranged in the housing element 4. Therefore, the housing element 4 is also referred to as a pump plate 14.

One end 29 of the drive shaft 9 projects into the housing element 4 to drive the hydraulic pump 20. The intermediate plate 5 comprises a through-hole 19 through which the drive shaft 9 extends.

The hydraulic pump 20 takes the form of an external gear pump with a gear wheel 21 and a gear wheel 22. The gear wheels 21, 22 are rotatably mounted in the housing element 4, for example via pedestal bearings. The gear wheel 21 is connected in a non-rotatable manner to the end 29 of the drive shaft 9 by a coupling device 24. Therefore, the gear wheel 21 is also referred to as the driving gear wheel 21. The gear wheel 22 is driven by the gear wheel 21 and is therefore referred to as a driven gear wheel 22.

The two gear wheels 21, 22 are associated in a manner known per se with an axial plate 23. The axial plate 23 is arranged in the axial direction between the gear wheels 21, 22 and the intermediate plate 5. The drive shaft 9 also extends through the axial plate 23.

The two housing elements 3, 4 are formed of an aluminum material. The drive shaft 9, like the fixed bearing 12, in particular a bearing outer ring 26 of the fixed bearing 12, is formed of a steel material. The different materials of the housing elements 3, 4, the drive shaft 9 and the bearing outer ring 26 have different thermal expansions. Therefore, a spring device 30 is advantageously used for bearing fixation.

The intermediate plate 5, on the one hand, performs a sealing function between the two housing elements 3, 4. In addition, the intermediate plate 5 comprises openings and/or through-holes that allow hydraulic medium to pass through. In addition, the intermediate plate 5 serves to provide at least one valve function.

In addition to the drive shaft 9, the spring device 30, which here takes the form of a disk spring, extends through the through-hole 19 and is used to secure the bearing device 15. This means that an additional retaining ring can be dispensed with.

The spring device 30 is in contact with the outer ring 26 of the fixed bearing 11 in such a way that an axial clamping force is exerted on the outer ring 26 of the fixed bearing 11 from left to right in FIGS. 1 and 2. On the other side, the outer ring 26 is supported in the housing element 3. The inner ring 25 is pressed onto a shoulder of the drive shaft 9, for example.

The fixed bearing 11 takes the form of a rolling bearing with the inner ring 25 and the outer ring 26. Rolling elements 27 are arranged between the inner ring 25 and the outer ring 26. The spring device 30 serves in axial bearing fixation of the outer ring 26 of the fixed bearing 11.

Figure 3:
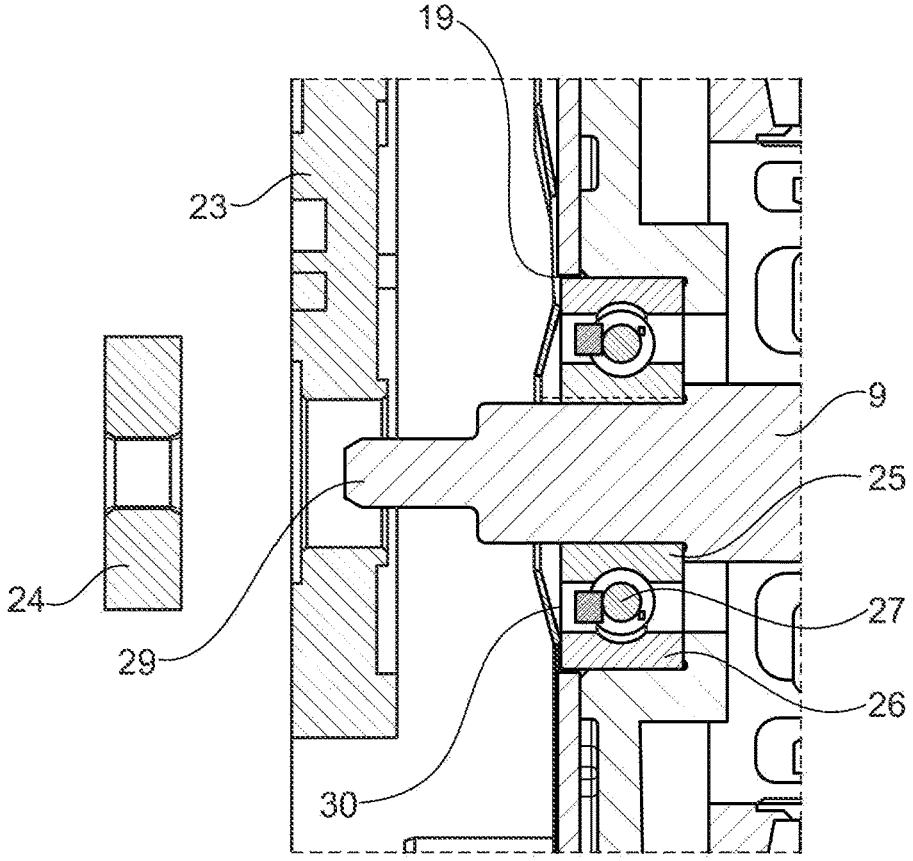
FIG. 3 shows an exploded sectional view of the bearing device of FIGS. 1 and 2.

For the purpose of clarification, FIG. 3 shows a detail of FIGS. 1 and 2 in which the axial plate 23 is shown spaced apart from the intermediate plate 5, the spring device 30 and the drive shaft 9. The coupling device 24 is also shown disassembled from the drive shaft 9 or its end 29. The spring device 30 passes through the intermediate plate 5 through the through-hole 19.

LIST OF REFERENCE SYMBOLS

1 Electric-motor-driven hydraulic pump actuator
2 Housing
3 Housing element
4 Housing element
5 Intermediate plate
6 Electric motor
7 Rotor
8 Stator
9 Drive shaft
10 Electric motor drive
11 Fixed bearing
12 Floating bearing
13 Valve plate
14 Pump plate
15 Bearing device
16 Stator winding
17 Centering means
18 Centering means
19 Through-hole
20 Hydraulic pump
21 Gearwheel
22 Gear wheel
23 Axial plate
24 Coupling device
25 Inner ring
26 Outer ring
27 Rolling element
29 End
30 Spring device

The invention claimed is:

1. An electric-motor-driven hydraulic pump actuator comprising:

two plate-like housing elements sealingly connected to one another via an intermediate plate disposed between the two plate-like housing elements so as to form a housing, a drive shaft rotatably mounted in the housing and extending through a through-hole of the intermediate plate, and a bearing device configured to support the drive shaft, the bearing device secured within one of the two plate-like housing elements via a spring device configured to engage the bearing device via the through-hole.

2. The electric-motor-driven hydraulic pump actuator according to claim 1, wherein the spring device exerts an axial clamping force on the bearing device in the one of the two plate like housing elements.

3. The electric-motor-driven hydraulic pump actuator according to claim 1, wherein the spring device is a disk spring preloaded against the bearing device.

4. The electric-motor-driven hydraulic pump actuator according to claim 1, further comprising two gear wheels of a gear pump disposed within a remaining one of the two plate-like housing elements, and the spring device preloads an axial plate in direction of the two gear wheels.

5. The electric-motor-driven hydraulic pump actuator according to claim 4, wherein the bearing device is arranged in the one of the two plate-like housing elements and comprises a fixed bearing and a floating bearing.

6. The electric-motor-driven hydraulic pump actuator according to claim 5, wherein a rotor of the electric motor drive is arranged on the drive shaft in the one of the two plate like housing elements between the fixed bearing and the floating bearing.

7. The electric-motor-driven hydraulic pump actuator according to claim 1, wherein an end of the drive shaft projecting from the one of the two plate-like housing elements extends through the intermediate plate and into a remaining one of the plate-like housing elements and drives a hydraulic pump in a remaining one of the two plate-like housing elements.

8. The electric-motor-driven hydraulic pump actuator according claim 1, wherein the bearing device comprises a rolling bearing and the one of the two plate-like housing elements is formed of a housing material having a different thermal expansion than material of an bearing outer ring of the rolling bearing.

9. The electric-motor-driven hydraulic pump actuator according to claim 7, wherein the hydraulic pump is an external gear pump.

10. The electric-motor-driven hydraulic pump actuator according to claim 3, wherein the bearing device is a rolling bearing and the disk spring is preloaded against an outer ring of the rolling bearing.

11. The electric-motor-driven hydraulic pump actuator according to claim 4, wherein the axial plate is arranged axially adjacent to the two gear wheels.

12. The electric-motor-driven hydraulic pump actuator according to claim 4, wherein the axial plate is arranged between the two gear wheels and the intermediate plate.

13. An electric-motor-driven hydraulic pump actuator comprising:

two plate-like housing elements sealingly connected to one another via an intermediate plate disposed between the two plate-like housing elements so as to form a housing, a drive shaft rotatably mounted in the housing and extending through a through-hole of the intermediate plate, a bearing device configured to support the drive shaft, the bearing device disposed within one of the two plate-like housing elements, a hydraulic pump drivably connected to the drive shaft, the hydraulic pump having:

a first driving gear wheel and a second driven gear wheel disposed within a remaining one of the two plate-like housing elements, and an axial plate arranged between the intermediate plate and the first driving gear wheel in an axial direction, and a spring configured to pre-load:

the bearing device via the through-hole of the intermediate plate, and the axial plate.

14. The electric-motor-driven hydraulic pump actuator according to claim 13, wherein the spring is configured to pre-load the bearing device in a first axial direction and pre-load the axial plate in a second axial direction.

15. The electric-motor-driven hydraulic pump actuator according to claim 14, wherein the spring directly engages the bearing device and the axial plate.

16. The electric-motor-driven hydraulic pump actuator according to claim 13, wherein the first driving gear wheel is non-rotatably connected to the drive shaft and the second driven gear wheel is driven by the first driving gear wheel.

17. The electric-motor-driven hydraulic pump actuator according to claim 13, wherein the bearing device comprises a first bearing and a second bearing.

18. The electric-motor-driven hydraulic pump actuator according to claim 17, wherein the first bearing is a rolling bearing having an outer ring, and the outer ring is pre-loaded within the one of the two plate-like housing elements via the spring and the through-hole.

19. The electric-motor-driven hydraulic pump actuator according to claim 13, further comprising:

a rotor arranged on the drive shaft, a stator disposed within the one of the two plate-like housing elements, the rotor configured to be rotatable within the stator.

20. The electric-motor-driven hydraulic pump actuator according to claim 13, wherein the bearing device is disposed at least partially within the through-hole.

* * * * *